US006775931B2

(12) United States Patent
Hokkirigawa et al.

(10) Patent No.: US 6,775,931 B2
(45) Date of Patent: Aug. 17, 2004

(54) STUD AND SHOE PROVIDED WITH THE STUDS

(75) Inventors: Kazuo Hokkirigawa, Yonezawa (JP); Motoharu Akiyama, Nagano-ken (JP); Noriyuki Yoshimura, Nagano-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/125,799

(22) Filed: Apr. 18, 2002

(65) Prior Publication Data

US 2002/0152644 A1 Oct. 24, 2002

(30) Foreign Application Priority Data

Apr. 19, 2001 (JP) ..... 2001-121594

(51) Int. Cl.[7] ..... A43B 5/00; A43C 15/00
(52) U.S. Cl. ..... 36/134; 36/67 R; 36/127
(58) Field of Search ..... 36/134, 67 R, 36/67 D, 127

(56) References Cited

U.S. PATENT DOCUMENTS 4,644,672 A * 2/1987 Dassler et al. ..... 36/134
4,674,207 A 6/1987 Yamaguchi
4,698,924 A * 10/1987 Greiner et al. ..... 36/134
4,712,318 A 12/1987 Greiner et al.
4,833,796 A * 5/1989 Flemming ..... 36/134
5,916,499 A 6/1999 Murayama et al.
5,996,260 A * 12/1999 MacNeill ..... 36/134
6,112,433 A 9/2000 Greiner

FOREIGN PATENT DOCUMENTS

GB 2 206 030 12/1988

OTHER PUBLICATIONS

Article: *Development of Hard and Porous Carbon Material "RB Ceramics" Using Rice Bran as a Starting Material;* (Translation from "Zairyou Kagaku", vol. 17, No. 6, pp. 24 to 27, May 1997); Kazuo Hokkirigawa; 10 pages.

* cited by examiner

*Primary Examiner*—Marie Patterson
(74) *Attorney, Agent, or Firm*—Flynn, Thiel, Boutell & Tanis, P.C.

(57) ABSTRACT

The invention provides a stud for a shoe which is light in weight, has a long service life and excellent abrasion resistance, and a shoe using the same. The stud for the shoe is made up of a central protruding member, a seating plate, and peripheral binding members. The seating plate is formed of a metallic material, and the central protruding member or the peripheral binding members are formed of RB ceramic or CRB ceramic. The shoe is fabricated by securely attaching the studs to an outsole thereof.

16 Claims, 2 Drawing Sheets

STUD AND SHOE PROVIDED WITH THE STUDS

FIELD OF THE INVENTION

The present invention relates to a stud for a shoe, and a shoe using the studs, and more specifically, to a stud for a shoe, light in weight, and having not only an excellent non-skid performance or gripping performance but also an excellent walking performance on a hard surface of a road such as a pavement, a concrete road, and so forth, or on a hard floor, suitable, particularly, for use in sports shoes such as golf shoes, soccer shoes, or baseball shoes, spikes, non-skid shoes for use in cold districts, and so forth, and a shoe using the same.

BACKGROUND OF THE INVENTION

Studs for shoes, for example, spikes, especially, spikes for use in sports shoes and non-skid shoes, are required to have excellent gripping performance and nonskid performance, and such performances are important from the viewpoint of providing comfortableness in wearing and safety as well.

As a constituent material of such studs, for example, spikes, and so forth, use is made of a corrosion resistant steel such as stainless steel and carbon steel, a metallic material such as titanium, and so forth, and a hard resin.

The metallic material is superior in strength, but, however, is also too hard as the constituent material of the studs to avoid impact resistance such as a feeling of a thrust coming up from below when a user is walking on a hard surface of a pavement or a concrete road, thereby aggravating the discomfort of the user. In addition, there are also problems that a steel-based material used in the studs renders the shoes heavier because of its high specific gravity while titanium is costly. Further, there is a problem with the hard resin that it has poor abrasion resistance and a short durability.

SUMMARY OF THE INVENTION

It is an object of the invention to overcome such drawbacks of the conventional studs as described above, and to provide a stud for a shoe, light in weight, having a long service life and excellent abrasion resistance, and a shoe using the same.

An RB ceramic for use in carrying out an embodiment of a stud according to the invention is a carbonaceous material obtained by utilizing rice bran, produced in a quantity of 900,000 tons a year in Japan and in a quantity of as much as 33 million tons a year throughout the world, and has been well known by researches carried out by Mr. Kazuo Hokkirigawa, the first inventor of the present invention (refer to "Functional Material", May issue, 1997, Vol. 17, No. 5, pp. 24–28).

In this literature, reference is made to a carbon material (hereinafter referred to as an RB ceramic) and the preparation thereof, in which the carbonaceous material is obtained by mixing and kneading defatted bran derived from rice bran with a thermosetting resin before kneading, followed by drying a compact obtained by pressure forming a kneaded mixture, and subsequently, baking the dried compact as dried in an atmosphere of an inert gas.

The RB ceramic and a new ceramic (a CRB ceramic as described later on) representing an improvement on the RB ceramic, for use in an embodiment of a stud according to the invention, are ceramic materials friendly to nature, obtained by using rice bran as a raw material, and by mixing defatted bran derived from the rice bran with a thermosetting resin before baking a mixture. These materials have excellent properties as described below:

- Higher hardness
- Smaller expansion coefficient
- porous micro structure
- good electrical conductivity
- small specific gravity and light weight
- very small friction coefficient
- excellent abrasion resistance
- easy to form and easy to fabricate in a die
- ceramics materials having varying characteristics can be produced by blending with various kinds of resins
- the materials being made of rice bran, they have little adverse effect on global environment, leading to conservation of natural resources.

The new ceramic described above is an improved material of the RS ceramic, and is a class of ceramic (referred to as the CRB ceramic) that is obtained by mixing defatted bran derived from rice bran with a thermosetting resin. More particularly, the defatted bran derived from rice bran and a thermosetting resin are mixed and kneaded, subjecting a kneaded mixture thus obtained to a primary baking in an inert gas at a temperature-in a range of 700 to 1000° C., and pulverizing the kneaded mixture after the primary baking into carbonized powders passing through a 100-mesh sieve.

The carburized powders and the thermosetting resin are further mixed and kneaded, pressure forming a kneaded mixture into a compact at a pressure in a range of 20 to 30 MPa, and subjecting the compact again to a heat treatment in an inert gas atmosphere at a temperature in a range of 100 to, 1100° C. The CRB ceramic differs largely from the RB ceramic in that, in contrast with the RB ceramic having a contraction ratio of the dimensions of the compact obtained by pressure forming to those of a finished compact at as high as 25%, the CRB ceramic has a contraction ratio in the order of not more than 3%, which is very small.

The inventors have discovered that these ceramic materials are light in weight and have a long service life, excellent abrasion resistance, insusceptibility to damage, and excellent workability, so that the same are suitable as a constituent material of a stud, for use in combination with a metallic material. The invention has been developed based on such knowledge as described above.

More specifically, the embodiment of the stud according to the invention comprises a central protruding member 1, a seating plate 2, and peripheral binding members 3, wherein the central protruding member 1 and the seating plate 2 are formed of a metallic material, respectively, and the peripheral binding members 3 are formed of the RB ceramic or the CRB ceramic.

Further, with a stud according to another embodiment of the invention, the central protruding member 1 and the peripheral binding members 3 may be formed of the RB ceramic or the CRB ceramic.

Furthermore, the invention provides a shoe using these studs for a shoe.

DETAILED DESCRIPTION OF THE PREFERRED EMBODIMENTS

Figure 1:
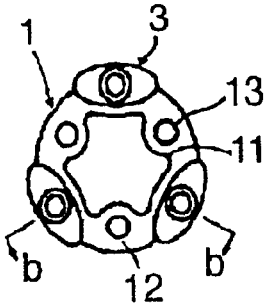
FIG. 1 is a perspective view of an embodiment of a stud according to the invention.

RB ceramic material and CRB ceramic material for use in carrying out an embodiment of a stud according to the invention are made of defatted bran derived from rice bran, as a main raw material, and a thermosetting resin.

The defatted bran may be of either a local domestic origin or a foreign origin regardless of the kind of rice.

Further, for the thermosetting resin, any thermosetting resin may be used as long as it has a thermosetting property, and typical examples thereof include a phenol resin, diarylphthalate resin, unsaturated polyester resin, epoxy resin, polyimide resin, and triazine resin. In particular, a phenol resin is preferably used.

Furthermore, a thermoplastic resin, such as a polyamide and so forth, can be used in combination with the thermosetting resin provided that it is used without departing from the spirit and scope of the invention.

A mixing ratio of the defatted bran to the thermosetting resin is 50 to 90:50 to 10 by weight, however, the mixing ratio of 70 to 80:30 to 20 is preferably adopted.

Next, a method of producing the CRB ceramic material is briefly described hereinafter. The method comprises the steps of mixing and kneading defatted bran derived from rice bran with a thermosetting resin before kneading, subjecting a kneaded mixture thus obtained to a primary baking in an inert gas at a temperature in a range of 700 to 1000° C., pulverizing the kneaded mixture after the primary baking into carbonized powders, mixing and kneading the carbonized powders with a thermosetting resin before kneading, pressure forming a kneaded mixture thus obtained into a compact at a pressure in a range of 20 to 30 MPa, and subjecting the compact again to a heat treatment at a temperature in a range of 100 to 1100° C. in an inert gas atmosphere.

A thermosetting resin in a liquid state, having a relatively small molecular weight, is desirable as the thermosetting resin for use in the primary baking.

A rotary kiln is normally used in carrying out the primary baking, and the baking time is in a range of 40 to 120 min. A mixing ratio of the carbonized powders obtained by the primary baking to the thermosetting resin is 50 to 90:50 to 10 by weight, however, a mixing ratio of 70 to 80:30 to 20 is preferably adopted.

The kneaded mixture of the carbonized powders and the thermosetting resin is pressure formed into the compact at a pressure in a range of 20 to 30 MPa, preferably, in a range of 21 to 25 MPa. A die for use is preferably at a temperature of about 150° C.

For the heat treatment, a well controlled electric furnace is normally employed, and the heat treatment time is in a range of about 60 to 360 min.

A heat treatment temperature is preferably in a range of 100 to 1100° C., and a warming rate up to the heat treatment temperature is required to be relatively moderate up to 500° C. In terms of more specific-values, the warming rate is in a range of 0.5 to 2° C./min, and is preferably about 1° C.

Further, in lowering the temperature of the compact after baking by the heat treatment in this manner, a cooling rate is required to be relatively moderate until reaching 500° C. Upon the temperature dropping below 500° C., the compact is left to cool by itself.

In terms of more specific values, the cooling rate is in a range of 0.5 to 4° C./min, and is preferably about 1° C./min.

Further, the inert gas used at the time of the primary baking as well as the secondary heat treatment may be any gas selected from the group consisting of helium, argon, neon, and nitrogen gas, however, nitrogen gas is preferably used.

The stud according to the embodiment of the invention can be used as appropriate in combination with a conventional metal-based stud, a hard resin-based stud, a stud made of other synthetic resins, or a stud made of an elastic or a soft material, such as natural rubber, synthetic rubber, and other elastomers.

Further, for an outsole of a shoe, use is preferably made of a synthetic resin, a synthetic rubber, natural rubber, or a synthetic elastomer, in common use as a conventional material for the outsole.

The synthetic resin may be any synthetic resin, if hard and strong to a degree, selected from the group consisting of hard polyethylene, a polyolefin such as polypropylene, a polyamide such as nylon 66, a polycarbonate, and so forth.

Further, examples of the synthetic rubber include butadiene rubber, styrene-butadiene rubber, acrylonitrile- butadiene rubber, isoprene rubber, chloroprene rubber, butyl rubber, ethylene-polypropylenediene rubber, acrylic rubber, urethane rubber, and so forth.

Figure 2:
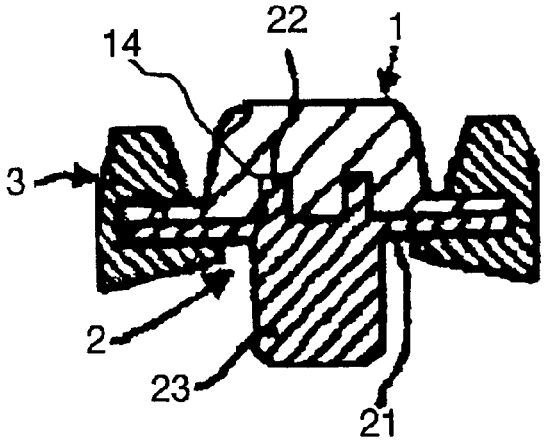
FIG. 2 is a cross sectional view of the stud taken on line 2—2 in FIG. 1.
Figure 3:
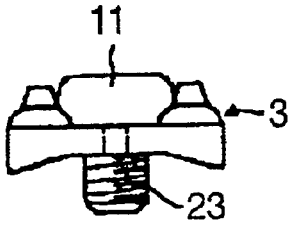
FIG. 3 is a side view of the stud shown in FIG. 1.

With the stud according to the embodiment of the invention, protruded parts thereof are preferably made up of a main protruding member 1 disposed at the center, and protrusions of peripheral binding members 3 disposed around the main protruding member 1, as shown in FIGS. 1 to 3, from the viewpoint of avoiding a concentration of force on the main protruding member 1 at the center when the shoes are worn by a user. Further, the main protruding member 1 can be formed in the shape of a pointed conical protrusion, although not shown in the figures.

According to the invention, the central protruding member 1 and a seating plate 2 can be formed of a metallic material, and the peripheral binding members 3 can be formed of the RB ceramic or the CRB ceramic, or the central protruding member 1 and the peripheral binding members 3 can be formed of the RB ceramic or the CRB ceramic.

Otherwise, the central protruding member 1 and the seating plate 2 can be formed of a metallic material, and integrally with each other, for use in combination with the peripheral binding members 3 formed of the RB ceramic or the CRB ceramic.

Further, the seating plate 2 can be formed of a metallic material, and the central protruding member 1 and the peripheral binding members 3 can be formed of the RB ceramic or the CRB ceramic, and integrally with each other in such a way as to wrap up the seating plate 2. In this case, the central protruding member 1 may be changed in shape depending on the stress to which the same is subjected. For example, an angularity of the conical protrusion thereof can be changed in a range of an acute angle to an obtuse angle to prevent the central protruding member 1 from being excessively loaded. Furthermore, it is also possible to render the apex of the conical protrusion flat so as to cause a load imposed thereon to be dispersed or to form the apex thereof in the shape of a plurality of conical protrusions as ranged.

Further, the RB ceramic or the CRB ceramic for use in carrying out the embodiment of the stud according to the invention is light in weight, and has a characteristic of excellent abrasion resistance, however, one subjected to the secondary heat treatment at a high temperature has susceptibility to buckling when a large load is imposed thereon because it is slightly lower in mechanical strength. With the present invention, it is therefore preferable to form the seating plate from a metallic material having a high mechanical strength for use in combination with the central protruding member and the peripheral binding members, formed from a metallic material or a hard resin other than the metallic material.

In the case of using the CRB ceramic in carrying out the embodiment of the stud according to the invention, the CRB ceramic obtained by baking at a temperature lower than about 500° C. generally has characteristics such as toughness and excellent mechanical property while the same obtained by baking at a high temperature not lower than 600° C. generally has characteristics such as a high porosity, high hardness, and light weight, so that it is possible to make selective use thereof depending on the required properties of a given stud.

The embodiments of the invention are summed up as follows:

(1) A stud for a shoe, comprising a central protruding member, a seating plate, and peripheral binding members, wherein the seating plate is formed of a metallic material, and the central protruding member or the peripheral binding members are formed of an RB ceramic or CRB ceramic.

(2) A stud for a shoe as set forth in item (1) above, wherein the seating plate and the central protruding member are formed of the RB ceramic or the CRB ceramic, integrally with each other.

(3) A stud for a shoe as set forth in item (1) above, wherein the seating plate, the central protruding member, and the peripheral binding members are formed of the RB ceramic or the CRB ceramic, integrally with each other.

(4) A stud for a shoe as set forth in any one of items (1) to (3) above, wherein the CRB ceramic is obtained by a secondary heat treatment applied at a temperature in a range of 200 to 1000° C.

(5) A stud for a shoe as set forth in any one of items (1) to (4) above, wherein the peripheral binding members are each provided with a peripheral protrusion lower in profile than a protrusion of the central protruding member.

(6) A stud for a shoe as set forth in any one of items (1) to (5) above, wherein the protrusion of the central protruding member has an angularity of an optional angle in a range of an acute angle to an obtuse angle.

(7) A stud for a shoe as set forth in any one of items (1) to (6) above, wherein the protrusion of the central protruding member is in any one shape selected from the group of a shape having one apex of the protrusion and a shape having a plurality of apexes thereof.

(8) A shoe provided with a plurality of studs each comprising a central protruding member made of metal, disposed on parts of an outsole thereof, and a plurality of the studs as set forth in any one of items (1) to (7) above, disposed on other parts of the outsole, each comprising the central protruding member made of the RB ceramic or the CRB ceramic, and lower in profile than the studs comprising the central protruding member made of metal.

(9) A shoe as set forth in item (8) above, for use in golf, soccer, baseball or track.

EMBODIMENTS (Production of a Precursor of the CRB Ceramic)

The precursor of the CRB ceramic for use in fabrication of a constituent member making up a main protruded part of a stud for a shoe was produced as follows:

75 kg of defatted bran derived from rice bran was mixed and kneaded with 25 kg of phenol resin (resol) in a liquid state while heating both to 50 to 60° C. A plastic and homogeneous mixture was obtained.

The mixture was subjected to a primary baking at 900° C. in a nitrogen atmosphere in a rotary kiln for 60 minutes. Subsequently, a baked product thus obtained was screened through a 100-mesh sieve, thereby obtaining carbonized powders 50 to 250 mm in particle diameter. 75 kg of thus obtained carbonized powder was mixed and kneaded with 25 kg of a phenol resin (resol) in a solid state while heating both to 100 to 150° C., thereby obtaining the precursor of the CRB ceramic, composed of a plastic homogeneous mixture.

The embodiments of the invention are described hereinafter with reference to the accompanying drawings.

Embodiment 1

There is shown an example of fabricating a stud (wherein a central protruding member 1 and a seating plate 2 are made of stainless steel, and peripheral binding members 3 are made of the CRB ceramic) according to an embodiment 1 of the invention.

The stud comprises a central protruding member 1 and a seating plate 2, both made of stainless steel, and peripheral binding members 3 made of the CRB ceramic. The central protruding member 1 is comprised of a stud protrusion 11 substantially in the shape of a hexagonal prism, and a flange 12 circular in shape, provided integrally therewith, around the periphery of the lower end thereof. The flange 12 is provided with a plurality of holes 13 defined therein, and the stud protrusion 11 is provided with slender grooves 14, defined in the bottom face thereof, for fitting onto small protrusions 22 of the seating plate 2.

The seating plate 2 comprises a disk 21, a plurality of the small protrusions 22 protruding from the upper face of the disk 21, and a threaded part 23 for fixedly attaching the stud to an outsole of the shoe, provided on the underside of the disk 21 in such a way as to hang therefrom. The small protrusions 22 are inserted into the slender grooves 14 of the stud protrusion 11, respectively. The disk 21 is provided with a plurality of holes defined at positions thereon, corresponding to respective positions of the plurality of the holes 13 of the flange 12.

The central protruding member 1 and the seating plate 2 are linked together with the peripheral binding members 3 in the following manner. First, the seating plate 2 is covered directly by the central protruding member 1, and the stud protrusion 11 is brought into intimate contact with the disk 21. Since a height of the small protrusions 22 of the seating plate 2 is substantially equivalent to a depth of the slender grooves 14 of the stud protrusion 11, both parts come into intimate contact with each other.

Subsequently, the central protruding member 1 integrated with the seating plate 2 excluding the threaded part 23 is placed inside a die in the shape of the central protruding member 1 and the seating plate 2 excluding the threaded part 23, and the precursor of the CRB ceramic is injected therein to be pressure formed into a compact in the shape shown in FIGS. 1 and 2 at a pressure of 22 MPa. The die for use is at a temperature of about 150° C. The compact is taken out of the die, and is subjected to a heat treatment in a nitrogen atmosphere whereby the compact is heated at a warming rate of 1° C./min up to 500° C., held at 500° C. for 60 min, heat treated at 800° C. for about 120 min before lowering the temperature of the compact at a cooling rate in a range of 2 to 3° C./min until reaching 500° C. and upon the temperature dropping below 500° C., the compact is left to cool by itself. The thickness of the peripheral binding members 3, on the side of the seating plate 2, is rendered thicker on the peripheral side of the disk 21, and thinner on the center side thereof.

A protrusion of the respective peripheral binding members 3 is made up of a protrusion in the shape of an elliptical hemisphere, and a protrusion in the shape of a truncated cone, disposed at the center of the apex of the former, and is as shown in FIG. 1 to FIG. 3, arranged so as to surround the stud protrusion 11 which is the protruded part of the central protruding member 1, and so as to be lower in profile than the protruded part described.

The central protruding member 1 is securely bonded to the seating plate 2 with the peripheral binding members 3, and in addition, a concentration of force towards the central protruding member 1 is prevented by the protrusion of the respective peripheral binding members 3. Furthermore, the binding members 3 can fulfill a function similar to that of a packing upon attaching the stud to the outsole of a shoe by rendering the thickness thereof, on the side of the seating plate 2, thicker on the peripheral side of the disk 21, and thinner on the center side thereof.

Embodiment 2

(A Central Protruding Member and a Seating Plate are Formed of Metal, and Integrally with each other)

A stud is fabricated in a manner similar to that for the stud according to the embodiment 1 of the invention except that use is made of a stainless steel structure fabricated by forming the central protruding member integrally with the seating plate in the die.

Embodiment 3

(An Embodiment wherein a Central Protruding Member and Peripheral Binding Members are Formed of the CRB Ceramic, Integrally with each other)

A seating plate 2 is prepared, and is placed in a die corresponding to the shape of a central protruding member 1 and peripheral binding members 3 (a threaded part 23 is not placed in the die).

Subsequently, the same precursor of the CRB ceramic as produced according to the embodiment 1 is pressure formed into a compact at a pressure of 25 MPa. The die for use is at a temperature of about 150° C.

The compact is taken out of the die, and is subjected to a heat treatment in a nitrogen atmosphere whereby the compact is heated at a warming rate of 1° C./min up to 500° C., held at 500° C. for 60 min, and heat treated at 900° C. for about 120 min. Thereafter, the temperature of the compact is lowered at a cooling rate in a range of 2 to 3° C./min until reaching 500° C. and upon the temperature dropping below 500° C., the compact is left to cool by itself.

A stud is obtained wherein the seating plate 2 made of metal is formed integrally with the central protruding member 1 and the peripheral binding members 3, both made of the CRB ceramic.

Embodiment 4

(Fabrication of golf shoes)

Figure 4:
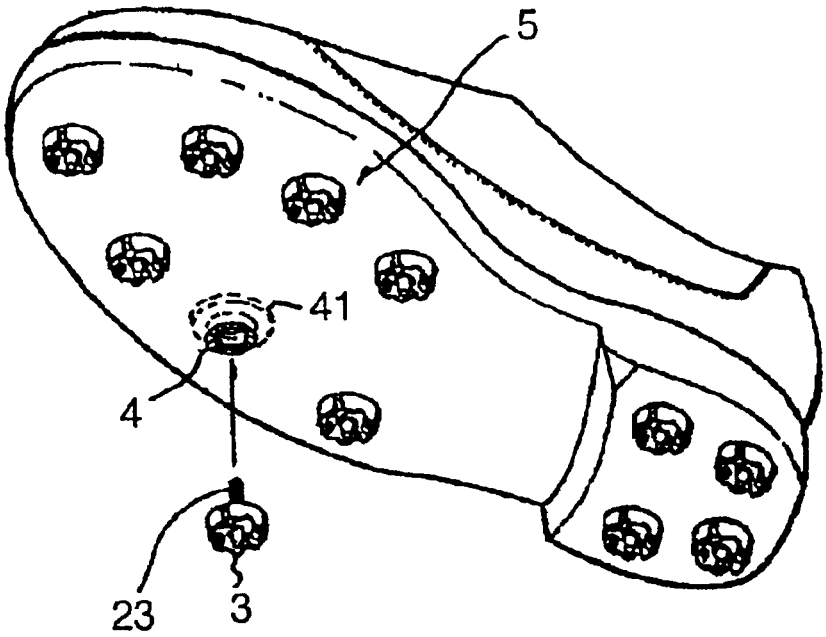
FIG. 4 is a perspective view of a shoe with the studs securely attached thereto.

As shown in FIG. 4, the stud fabricated according to the embodiment 1 or 2 is screwed into a female thread 41 of a fixture mount 4 of an outsole 5 of a shoe. The constituent material of the outsole 5 is hard rubber. Golf shoes comfortable to wear, having excellent gripping performance and non-skid performance are obtained. In the figure, a central protruding member 1 is not shown.

Embodiment 5

(Fabrication of Golf Shoes using Studs made of the CRB Ceramic in Combination with Studs made of Metal)

Figure 5:
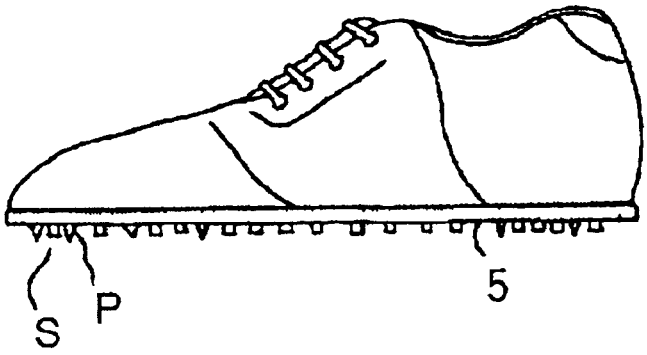
FIG. 5 is a side view of a shoe with the studs securely attached thereto.

As shown in FIG. 5, with golf shoes according to an embodiment 5, spikes P made of stainless steel, taller than studs made of the CRB ceramic, are disposed in parts of an outsole 5, on which the weight of a user rests while studs S, as other studs, comprising the central protruding member formed of the CRB ceramic, according to the embodiment 3, are disposed.

Golf shoes, light in weight and comfortable to wear, are obtained wherein a good gripping effect of the spikes made of stainless steel is exhibited when a user is walking on a concrete or cart road, and an excellent nonskid performance effected by gripping of the grass with the studs made of the CRB ceramic is exhibited when the user is walking on the grass.

Thus, the stud and shoes using the studs according to the embodiments of the invention are able to provide shoes light in weight and comfortable to wear, having a long service life, an excellent abrasion resistance, excellent gripping performance, and excellent non-skid performance.

What is claimed is:

1. An integrally formed stud for a shoe, comprising:

a central protruding member;

a sealing plate; and peripheral binding members, wherein the seating plate is formed of a metallic material and at least one of the central protruding member and the peripheral binding members are formed of an RB ceramic or a CRB ceramic obtained by a secondary heat treatment at a temperature in the range of 200 to 1000° C.

2. The stud of claim 1, wherein the central protruding member and the peripheral binding member are formed of an RB ceramic or a CRB ceramic.

3. The stud of claim 1, wherein the peripheral binding members are each provided with a peripheral protrusion having a lower profile than the protrusion of the central protruding member.

4. The stud of claim 1, wherein the protrusion of the central protruding member has at least one apex.

5. The stud of claim 1, wherein a CRB ceramic is used.

6. A shoe comprising a first set of studs and a second set of studs disposed on an outsole of the shoe, each stud of said first set of studs comprising a central protruding member made of metal and each stud of said second set of studs comprising a central protruding member made of an RB ceramic or CRB ceramic and having a lower profile than the metal central protruding members, a sealing plate made of a metallic material and peripheral binding members.

7. The shoe of claim 6, wherein the peripheral binding members are made of an RB ceramic or CRB ceramic and each stud of said second set of studs are integrally formed.

8. The shoe of claim 6, wherein a CRB ceramic is used.

9. A stud for a shoe, comprising:

a central protruding member formed of an RB ceramic or a CRB ceramic;

a seating plate formed of a metallic material; and peripheral binding members, wherein the central protruding member is integrally formed together with the seating plate, the RB ceramic is a carbonaceous material obtained by mixing a degreased bran derived from rice bran with a thermosetting resin to form a mixture, kneading the mixture, pressure-forming the kneaded mixture, drying the formed kneaded mixture and firing the dried and formed kneaded mixture in an inert gas atmosphere at a temperature in the range of 700 to 1000° C. and the CRB ceramic is obtained by mixing carbonized powders of the RB ceramic to form a second mixture, kneading the second mixture, pressure forming the kneaded second mixture at a pressure in a range of 20 to 30 MPa to form a workpiece and subjecting the workpiece to a heat treatment at a temperature in the range of 200 to 1100° C. in an inert gas atmosphere.

10. The stud of claim 9, wherein the peripheral binding members are each provided with a peripheral protrusion having a lower profile than the protrusion of the central protruding member.

11. The stud of claim 9, wherein the protrusion of the central protruding member has at least one apex.

12. The stud of claim 9, wherein a CRB ceramic is used.

13. A stud for a shoe, comprising:

a central protruding member formed of an RB ceramic or a CRB ceramic;

a seating plate formed of a metallic material; and peripheral binding members formed of an RB ceramic or a CRB ceramic, wherein the central protruding member and the peripheral binding members are integrally formed together with the seating plate, the RB ceramic is a carbonaceous material obtained by mixing a degreased bran derived from rice bran with a thermosetting resin to form a mixture, kneading the mixture, pressure forming the kneaded mixture, drying the formed kneaded mixture and firing the dried and formed kneaded mixture in an inert gas atmosphere at a temperature in the range of 700 to 1000° C. and the CRB ceramic is obtained by mixing carbonized powders of the RB ceramic to form a second mixture, kneading the second mixture, pressure forming the kneaded second mixture at a pressure in a range of 20 to 30 MPa to form a workpiece and subjecting the workpiece to a heat treatment at a temperature in the range of 200 to 1100° C. in an inert gas atmosphere.

14. The stud of claim 13, wherein the peripheral binding members are each provided with a peripheral protrusion having a lower profile than the protrusion of the central protruding member.

15. The stud of claim 13, wherein the protrusion of the central protruding member has at least one apex.

16. The stud of claim 13, wherein a CRB ceramic is used.

* * * * *